US007041918B1

(12) United States Patent
Wu

(10) Patent No.: US 7,041,918 B1
(45) Date of Patent: May 9, 2006

(54) ELECTRICAL POWER OUTLET

(76) Inventor: Chia-Chen Wu, 3F, No. 7, Alley 46, Lane 553, Jhongsiao E. Rd., Sec. 4, Taipei City (TW)

( * ) Notice: Subject to any disclaimer, the term of this patent is extended or adjusted under 35 U.S.C. 154(b) by 0 days.

(21) Appl. No.: 11/125,265

(22) Filed: May 10, 2005

(51) Int. Cl.
*H01R 33/96* (2006.01)

(52) U.S. Cl. ..... 200/51.09; 200/51.1; 439/346

(58) Field of Classification Search ..... 200/51.09, 200/51.1, 51.12, 51 R, 51.05, 51.02; 439/180, 439/188, 346
See application file for complete search history.

(56) References Cited

U.S. PATENT DOCUMENTS 4,995,017 A * 2/1991 Sellati et al. ..... 307/86
5,112,237 A * 5/1992 Yang ..... 439/188
5,113,045 A * 5/1992 Crofton ..... 200/51.09
6,062,886 A * 5/2000 Chen ..... 439/188
6,111,210 A * 8/2000 Allison ..... 200/51.09
6,229,107 B1 * 5/2001 Flint et al. ..... 200/51.09
6,455,789 B1 * 9/2002 Allison ..... 200/51.09
6,750,410 B1 * 6/2004 Lee ..... 200/51.03
6,773,283 B1 * 8/2004 Yoshimatsu et al. ..... 439/180
2002/0153232 A1 * 10/2002 Nakamura et al. ..... 200/51.09
2004/0206614 A1 * 10/2004 Fukuzaki et al. ..... 200/51.09

* cited by examiner

*Primary Examiner*—Michael Friedhofer
*Assistant Examiner*—Lisa Klaus
(74) *Attorney, Agent, or Firm*—Bacon & Thomas, PLLC

(57) ABSTRACT

The present invention is to provide a power outlet comprising two elastic pieces being formed at the rears of two insertion holes of the outlet panel, wherein one end of each elastic piece, including a fastening hole corresponding with the insertion holes, is disposed on a fastening board connected with the outlet panel and the other end of each elastic piece facing a base of a chassis of the power outlet is connected with one end of an elastic element. The other end of the elastic element is connected with the base of the chassis. In addition, a switch comprising a spring is connected between the fastening board and the base of the chassis, when the panel being compressed towards the inside of the chassis, the switch can be locked in position, enabling a user to safely and easily operate the electricity power outlet.

9 Claims, 3 Drawing Sheets

ELECTRICAL POWER OUTLET

FIELD OF THE INVENTION

The present invention generally relates to an electricity power outlet, more particularly to an electricity power outlet allows a power plug to be securely inserted and yet easy to unplug, wherein metallic connectors of the power plug can be smoothly inserted into insertion holes of an outlet panel while no power source is conducted, and will be securely fastened by elastic pieces in the outlet panel and conducted by power source while the power plug is further compressed into the outlet panel, enabling the power plug to be difficult to release from the outlet panel. When the outlet panel is compressed and again recovers to its uncompressed state, the metallic connectors of the power plug will be released from the fastening holes of the elastic piece, enabling the metallic connectors of the power plug to be unplugged easily and rapidly.

BACKGROUND OF THE INVENTION

Power outlet and plug are two intimately related objects. Since electrical products are ubiquitous in daily life, electricity becomes the most important power source of today. For this reason, the use of power outlet and plug becomes omnipresent in our everyday life. For example, one can easily see power outlet and plug in an office or at home. The power outlet normally delivers alternating current power source. The user can simply insert the power plug of any electrical product into the power outlet to receive the necessary electrical power.

However, when one inserts the power plug into a power outlet, it is often felt that some power outlets are too loose, while others are too tight. The looseness and tightness of the power outlet will also render the following effects:

First, when the power plug is too loosely inserted into the power outlet, the power plug will easily be released from the power outlet either spontaneously or after exerting a small pulling force, which will unexpected terminate the power supply and terminate the normal working condition of the electrical product. In addition, the metallic connectors (the rectangular blades or cylindrical pillars) of the power plug will easily be deformed due to the pulling force, making the power plug unrecoverably damaged.

Next, if the power plug is partly released from the power outlet, the user may accidentally touch the exposed metallic connectors, and experience electric shock. Since the metallic connectors of the power plug inserted in the conventional power outlet are already conducting electricity, the user will certainly experience electric shock when touching both of the exposed metallic connectors.

Further, when the power plug is too tightly inserted into the power outlet, the user would have experienced difficulties for inserting the power plug into the power outlet, that is, the user must exert a strong force to insert the power plug. Nevertheless, it will also be difficult later for the user to unplug the power plug. For some users, such a power plug is even impossible to unplug. Moreover, some users will pull the power cord if a power plug is difficult to unplug. In this manner, the copper wire inside of the power cord may be broken, which would produce short circuit or spark, and induce fire.

For the above reasons, it is deemed necessary to develop a new power outlet that allow the metallic connectors (rectangular blades or cylindrical pillars) of the power plug inserted in the power outlet to easily and rapidly release the power outlet when unplugging the power plug. In addition, the new power outlet should allow the power plug to be securely inserted without releasing from the outlet. This new power outlet should be applicable to the power plugs of all kinds of computer products and consumer electronic products, so as to increase the life of the power plug and overcome the drawbacks of the conventional power plug described above.

SUMMARY OF THE INVENTION

In accordance with the background description set forth above, it is not difficult to understand that the currently and commercially available power outlet does not include any position structure. Therefore, some power outlet will hold the inserted power plug too tight, while others too loose. However, whether the power plug is too tightly or too loosely inserted into a power outlet, it is unsafe for a user as an unexpected damage might be occurred. Therefore, based on the many years of industrial experiences and innumerable experimentation, the inventor of the present invention has developed an electrical power outlet that allows the power plug to be securely inserted and yet easy to unplug.

Therefore, it is an object of the present invention to provide a power outlet that can overcome the drawbacks known in the conventional power outlet. In the conventional power outlet, when a power plug is inserted into the power outlet, the power plug is easy to become either too loosely inserted or too tightly inserted. When it is too loosely inserted, the plug is easy to release from the power outlet. If the power plug is partly released from the power outlet, the user is likely to experience electric shock once the user touches the exposed metallic connectors. On the other hand, when the power plug is too tightly inserted in the power outlet, it is then difficult to either insert or unplug the power plug. If the user insists on pulling the power cord, the copper wire inside of the power cord may be broken, which would produce short circuit or spark, and induce fire. In the power outlet of the present invention, two elastic pieces are formed at the rears of two insertion holes of an outlet panel. One end of each elastic piece is disposed on the fastening board of the outlet panel. The other end of the elastic piece facing a base of a chassis of the power outlet is connected with one end of an elastic element. The other end of the elastic element is connected with the base of the chassis. Each elastic piece includes a fastening hole corresponding exactly with the insertion holes. Further, both ends of a switch are connected to the fastening board and the base of the chassis, respectively. The switch comprises a spring. When the panel is compressed towards the inside of the chassis, the switch and the spring thereof can be locked in position. Two metallic conducting elements are formed on the base corresponding to the two fastening holes. The metallic conducting elements act as an interface for conducting alternating current power source. In this manner, when the metallic connector of the power plug is inserted into the insertion hole (the first stage), no electricity is conducted, which can protect the user from experiencing electrical shock. After compressing further the panel in position (the second stage), the metallic connectors are securely locked by the fastening holes of the elastic pieces, and contact the metallic conducting elements. Therefore, the power plug is unlike to release from the power outlet. When the panel is compressed again, the originally locked position is then released. The power plug is now easy to unplug.

The above and other objects, features and advantages of the present invention will become apparent from the following detailed description taken with the accompanying drawings.

DETAILED DESCRIPTION OF THE PREFERRED EMBODIMENTS

Figure 1:
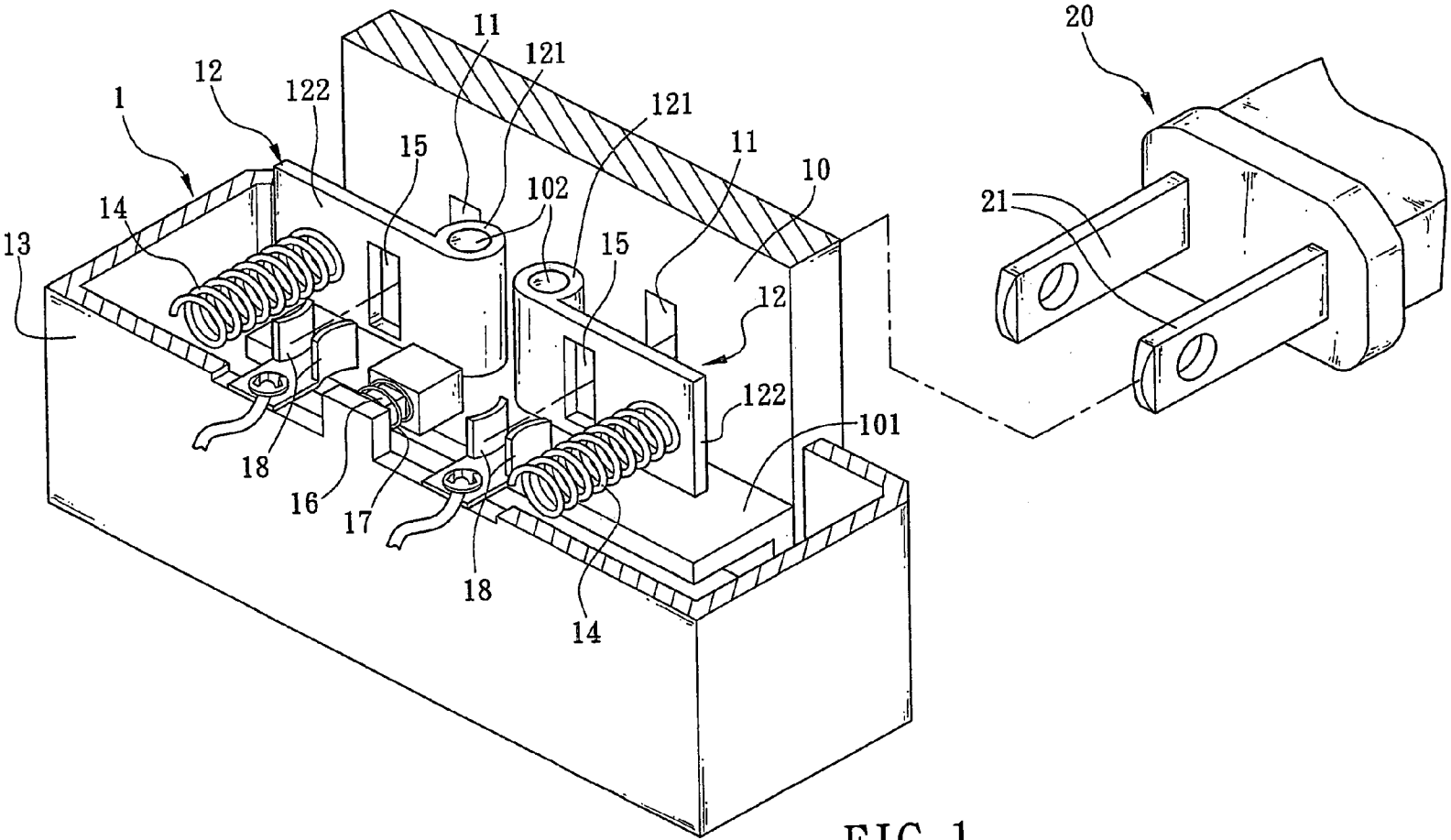
FIG. 1 is a perspective view of an electrical power outlet of the present invention.

Referring to FIG. 1, one preferred embodiment of an electrical power outlet of the present invention is illustrated. The power outlet of the present invention allows a power plug to be securely inserted therein and can be easily unplugged therefrom. The power outlet comprises a chassis 1 and a panel 10. The panel 10 comprises two insert holes 11 formed thereon. However, the insertion holes 11 of the panel 10 are not limited to the ones as illustrated. For example, the commercially available three-wire outlet, which has three insertion holes 11, is also considered within the scope of the present invention. In addition, the insertion holes 11 are not limited to a rectangular hole, a circular hole or a T-shape hole. Furthermore, an L-shape fastening board 101 is formed at one side of the panel 10 and extended inside the chassis 1.

In this particular embodiment, the fastening board 101 comprises two corresponding elastic pieces 12, one end 121 of each elastic piece 12 being disposed on a rod 102 of the fastening board 101. The other end 122 of each elastic piece 12 facing the base 13 of the chassis 1 is connected to one end of an elastic element 14. The other end of the elastic element 14 is connected to the base 13 of the chassis 1. In this particular embodiment, the elastic element 14 is a spring. Each elastic piece 12 comprises a fastening hole 15, which can be a rectangular hole, a circular hole or a T-shape hole. The fastening hole 15 corresponds exactly with the two insertion holes 11 of the panel 10 described above. When the panel 10 is compressed towards inside of the chassis 1, each elastic piece 12 fastened to one end 121 of the fastening board 101 is moved towards inside of the chassis 1. Relatively, the elastic element 14 at the other end 122 is deformed to produce a force, making the elastic piece 12 forming an inclination angle. After the force that compresses the panel 10 is eliminated, each elastic piece 12 will then recover to its original horizontal position.

Moreover, a switch 16 is disposed between the fastening board 101 and the base 13 of the chassis 1. In this particular embodiment, the switch is an on-off switch button. The switch 16 comprises a spring 17. When the panel 10 is compressed towards inside of the chassis 1, the switch 16 and the spring 17 thereon are shrunk inward and locked in position. When the panel 10 is compressed again, the switch 16 and the spring 17 thereon will be released from the locked position, which recovers the panel 10 to its original uncompressed position. In this particular embodiment, the switch 16 is an on-off switch button. However, other switch buttons are applicable and considered within the scope of the present invention, so long as they can achieve the purposes described above.

Furthermore, two metallic conducting elements 18 are disposed on the base 13. Each metallic conducting element 18 corresponds exactly with the two fastening holes 15 of the elastic pieces 12. The two metallic conducting elements 18 act as an interface for conducting alternating current power source.

Figure 2:
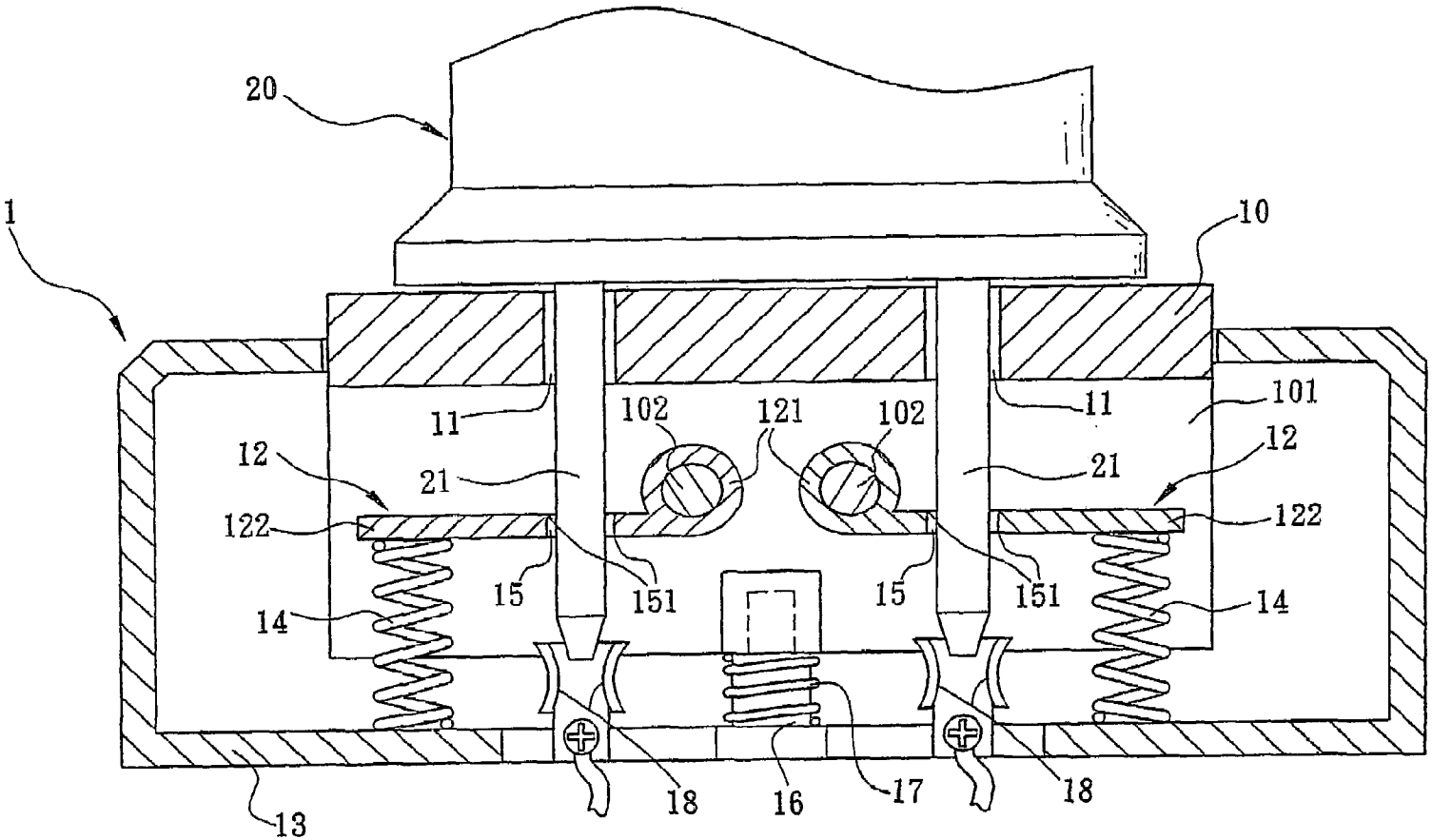
FIG. 2 is a top view of the electrical power outlet of the present invention.

Referring to FIG. 1 and FIG. 2, when the metallic connectors 21 of a power plug 20 is inserted into the insertion holes 11 of the panel 10, the metallic connectors 21 will also penetrate through the fastening holes 15 of the elastic piece 12. Since the metallic connectors 21 have not yet contacted with the metallic conducting elements 18 on the base 13, the power plug 20 in this first stage of insertion is not electrically connected to the power source. Therefore, the user is protected from electric shock in this first stage. The power outlet of the present invention is thus relatively safer.

Figure 3:
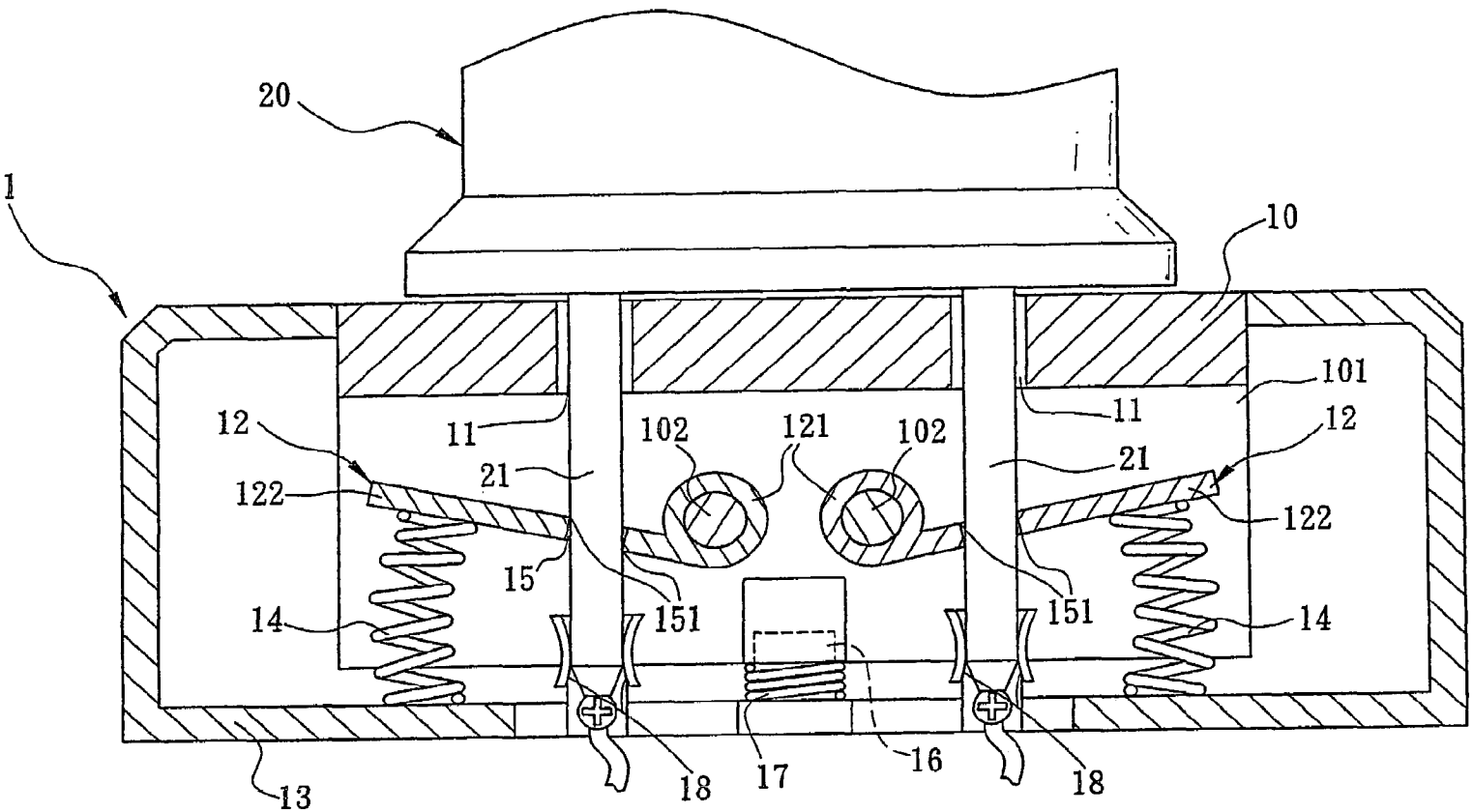
FIG. 3 is another top view of the electrical power outlet of the present invention.

Referring to FIG. 3, when the power plug 20 is further compressed into the chassis 1, one end 121 of each elastic piece 12 fastened on the fastening board 101 is moved towards the inside of the chassis 1. The elastic element 14 at the other end 122 of the elastic piece 12 produces a pushing force followed by the compression, which renders the elastic pieces 12 forming an inclination angle. Meanwhile, the diagonal inner rim 151 of the fastening hole 15 of each elastic piece 12 is tightly fastened to the outer surface of the metallic connectors 21, contacting the metallic conducting element 18. For this reason, the power plug 20 is electrically conducting and securely fastened in this second stage of insertion into the panel 10. Since the switch 16 is compressed, the panel 10 is then shrunk inward and locked in position. After the panel is compressed again, the switch 16 and the spring 17 thereon will release the inwardly shrunk locking position. The panel 10 is then recovered to its original uncompressed state, as shown in FIG. 2. At the same time, the fastening holes 15 of the elastic piece 12 will release the fastened metallic connector 21 of the power plug 20. Thus, the power plug 20 can be unplugged easily and rapidly from the insertion holes 11 of the outlet panel 10.

Accordingly, the power outlet of the present invention allows the metallic connector 21 of the power plug 20 to smoothly insert into the insertion holes 11 of the outlet panel 10, while no power source is conducted in the first stage of insertion. This can protect users from electric shock, which is relatively safer. When the power plug 20 is further compressed into the panel 10 (the second stage), the metallic connectors 21 will be securely fastened on the fastening hole 15 of the elastic piece 12, contacting the metallic conducting element 18. The power plug 20 is then difficult to release from the outlet. In addition, when the panel 10 is compressed again, the switch 16 and the spring 17 thereon will be released to the original position, making the panel 10 to recover to its uncompressed state. At the same time, the metallic connectors 21 of the power plug 20 will be released from the fastening holes 15 of the elastic piece 12. Therefore, the metallic connectors 21 of the power plug 20 can be unplugged easily and rapidly. Meanwhile, the metallic connectors 21 of the power plug 20 can be rectangular blades, cylindrical pillars, or in T-shape.

While the invention has been described by means of specific embodiments, numerous modifications and variations could be made thereto by those skilled in the art without departing from the scope and spirit of the invention set forth in the following claims.

What is claimed is:

1. An electrical power outlet, comprising:

a chassis, a panel being formed on the chassis and having a plurality of correspondingly formed insertion holes, one end of the panel having a fastening board extended inside the chassis;

a plurality of elastic pieces, one end of each elastic piece being disposed on the fastening board, the other end of each elastic piece facing a base of the chassis being connected to one end of an elastic element, the other end of the elastic element is connected to the base, the elastic piece further comprising a fastening hole, each fastening hole corresponding exactly to the insertion holes of the panel, whereby when the panel is compressed towards inside of the chassis, the fastening end of the elastic piece moves towards inside of the chassis, deforming the elastic element and generating a force, which makes each of the elastic piece forming an inclination angle, and each elastic piece recovers to its original horizontal position after the compressive force is eliminated;

a switch, both ends of which are connected to the fastening board and the base of the chassis, respectively, the switch comprising a spring, whereby when the panel is compressed towards the inside of the chassis, the switch and the spring thereof can be locked in position, the switch and the spring thereof will be released from the locked position after the panel is compressed again and recovering the panel to its originally uncompressed state; and a plurality of metallic conducting element, which is disposed on the base of the chassis, each metallic conducting element corresponding exactly to the fastening hole of the elastic piece, thereby forming an interface for conducting alternating current power source.

2. The electrical power outlet of claim 1, wherein the insertion hole is a rectangular hole.

3. The electrical power outlet of claim 1, wherein the insertion hole is a circular hole.

4. The electrical power outlet of claim 1, wherein the insertion hole is a T-shape hole.

5. The electrical power outlet of claim 1, wherein the elastic element comprises a spring.

6. The electrical power outlet of claim 1, wherein the fastening hole of the elastic piece is a rectangular hole.

7. The electrical power outlet of claim 1, wherein the fastening hole of the elastic piece is a circular hole.

8. The electrical power outlet of claim 1, wherein the fastening hole of the elastic piece is a T-shape hole.

9. The electrical power outlet of claim 1, wherein one end of the elastic piece is disposed on a rod formed on the fastening board.

* * * * *